US009321556B2

(12) United States Patent
Kuiper et al.

(10) Patent No.: US 9,321,556 B2
(45) Date of Patent: Apr. 26, 2016

(54) CONTAINER FOR CONTAINING A LIQUID, COMPRISING FLUID OUTLET MEANS

(75) Inventors: Wouter Alexander Kuiper, Drachten (NL); Matthijs Hendrikus Lubbers, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 942 days.

(21) Appl. No.: 13/503,967

(22) PCT Filed: Nov. 15, 2010

(86) PCT No.: PCT/IB2010/055163

§ 371 (c)(1), (2), (4) Date: Apr. 25, 2012

(87) PCT Pub. No.: WO2011/061668

PCT Pub. Date: May 26, 2011

(65) Prior Publication Data

US 2012/0217256 A1 Aug. 30, 2012

(30) Foreign Application Priority Data

Nov. 23, 2009 (EP) ..... 09176743

(51) Int. Cl.
*B65D 23/00* (2006.01)
*B65D 1/02* (2006.01)

(52) U.S. Cl.
CPC ..... *B65D 23/00* (2013.01); *B65D 1/023* (2013.01); *B65D 2205/00* (2013.01); *B65D 2581/34* (2013.01)

(58) Field of Classification Search
CPC ..... B65D 81/263; B65D 81/26; B65D 81/24; B65D 1/023; B65D 1/0223; B65D 1/02; B65D 25/42; B65D 25/40; B65D 25/38; B65D 47/06; B65D 47/04; B65D 23/00; A47J 41/022; A47J 41/02
USPC ..... 220/366.1, 592.28, 592.01, 675, 669, 220/623, 608; 215/371, 382, 42, 40, 310, 215/307; 222/572, 566, 547, 544
See application file for complete search history.

(56) References Cited

U.S. PATENT DOCUMENTS

| | | | | |
|---|---|---|---|---|
| 453,731 A | | 6/1891 | Ford | |
| 491,198 A | | 2/1893 | Straus | |
| 763,973 A | * | 7/1904 | Flynn et al. | B65D 1/023 215/378 |
| 1,343,670 A | * | 6/1920 | Goodman | A47J 36/24 126/261 |

(Continued)

FOREIGN PATENT DOCUMENTS

| | | | |
|---|---|---|---|
| CN | 101238036 | A | 8/2008 |
| CN | 201171614 | Y | 12/2008 |

(Continued)

*Primary Examiner* — Robert J Hicks

(57) ABSTRACT

A container (2) for containing a liquid such as water comprises a fluid outlet (10) having a hole (13) for allowing fluid to escape. A surface (12) defining the hole (13) is provided with at least one recessed portion (11). Because of the presence of the recessed portion (11), if the hole (13) of the fluid outlet (10) becomes plugged with one or more particles, fluid can still escape through a passage formed by the recessed portion (11). In one embodiment, the container (2) is equipped with at least one projection (15) extending inwardly in the container (2) from a position near the hole (13) of the fluid outlet (10). The projection (15) functions to avoid blockage of the entire hole (13), including the recessed portion (11), by a relatively large particle.

13 Claims, 2 Drawing Sheets

(56) References Cited

U.S. PATENT DOCUMENTS

| | | | | | |
|---|---|---|---|---|---|
| 1,366,056 | A | * | 1/1921 | Burns | B65D 1/0223 215/6 |
| 3,536,500 | A | * | 10/1970 | Cleereman | B65D 1/0223 215/382 |
| 4,566,601 | A | * | 1/1986 | Kuenzig | B65D 41/48 215/252 |
| 2004/0124197 | A1 | | 7/2004 | Hasegawa | |
| 2004/0129705 | A1 | | 7/2004 | Hasegawa | |
| 2007/0045216 | A1 | | 3/2007 | Gami | |
| 2008/0230573 | A1 | | 9/2008 | Enahoro | |

FOREIGN PATENT DOCUMENTS

| | | | |
|---|---|---|---|
| CN | 101489450 | A | 7/2009 |
| DE | 64303 | C | 6/1891 |
| DE | 202007009112 | U1 | 9/2007 |
| GB | 160305 | A | 3/1921 |
| GB | 496951 | A | 12/1938 |
| JP | 0395833 | U | 9/1991 |
| JP | 0872842 | A | 3/1996 |
| JP | 3061747 | U | 9/1999 |
| JP | 2004299766 | A | 10/2004 |
| WO | 2004086930 | A1 | 10/2004 |
| WO | 2009000254 | A1 | 12/2008 |

* cited by examiner

CONTAINER FOR CONTAINING A LIQUID, COMPRISING FLUID OUTLET MEANS

FIELD OF THE INVENTION

The present invention relates to a container for containing a liquid such as water, comprising fluid outlet means having a hole for allowing fluid to escape. Furthermore, the present invention relates to a device for heating a liquid, comprising a container as mentioned, and heating means for heating a liquid content of the container.

BACKGROUND OF THE INVENTION

Containers for containing a liquid are used in numerous devices. In many applications, it is intended to heat a quantity of liquid. This is realized by providing a container having an appropriate volume, and incorporating the container in a device, wherein furthermore heating means are provided and incorporated in the device as well. When the heating means are activated, the content of the container is heated to a desired temperature, and the hot liquid is further applied as desired.

In many cases, it is advantageous and practical if the container has a closed housing. However, when liquid is heated inside a closed space, pressure builds up inside that space, especially when the liquid is made to boil. Therefore, in such a case, it is advantageous to have a vent pipe which is arranged at a top position of the container, and which is adapted to let out gas such as air and steam, and, if necessary, liquid that is excess liquid due to expansion of the liquid. Without a vent pipe, there is a risk that pressure inside the container gets too high, as a result of which the container could be damaged.

Naturally, for a vent pipe to work properly and actually realize a pressure reducing effect, it is important that the vent pipe is open and that measures are taken for avoiding blockage of the vent pipe. For example, when water is boiled inside a container, there is a risk that particles such as pieces of bio film, scale particles, parts of packaging material and/or polystyrene parts plug the vent pipe and significantly reduce the pressure reducing function of the vent pipe. Also, when the application of the container is such that frequent cleaning is required, the particles may comprise pieces of cloth, pieces of sponge, etc. The particles are often capable of floating on the liquid, as a result of which the particles can actually reach the vent pipe. Regardless of the specific type of particles, blockage of the vent pipe by particles needs to be prevented, so that the pressure reducing function of the vent pipe is guaranteed, and dangerous situations cannot occur.

A well-known solution involves providing a mesh or screen at a suitable position in the container. However, over time, such a mesh or screen gets clogged with all kinds of particles. The more the mesh or screen gets contaminated, the less the pressure reducing function of the vent pipe is. Eventually, if the contamination is not noticed in time, the vent pipe may get clogged after all, so that there is still a risk of damage of the container.

JP2004299766A discloses a container suitable for containing water, comprising fluid outlet means having a hole for allowing fluid to escape, wherein a surface defining the hole is provided with at least one recessed portion.

SUMMARY OF THE INVENTION

It is an object of the present invention to provide a practical solution which is aimed at keeping fluid outlet means of a container for containing a liquid open at all times and under all circumstances, and which is far more reliable than the known solution of providing a mesh or screen. The object is achieved by a container in which a surface defining the hole of the fluid outlet means is provided with at least one recessed portion, further comprising at least one projection extending inwardly in the container from a position near the hole of the fluid outlet means.

According to the present invention, the surface defining the hole of the fluid outlet means has an interruption at at least one position, which interruption is realized on the basis of an arrangement of a recess in the surface. The at least one recess can be used for allowing air, steam or any other gas, and possibly also excess liquid to flow from the container to another place. If the hole of the fluid outlet means is blocked by some particle which has moved into this hole, the chance that this particle has such a shape that the recessed portion of the surface delimiting the hole is also blocked is practically zero.

Within the scope of the present invention, a cross-section of the surface defining the hole of the fluid outlet means may have any suitable shape, as long as the shape is with at least one recess.

In practical cases, the fluid outlet means may comprise a tube-like member, i.e. a vent pipe as known from the art, and the recessed portion of the surface defining the hole inside the tube-like member may be shaped like a groove extending along the length of the tube-like member. When the vent pipe is plugged, fluid including gases such as air and steam can still escape through the groove.

It is advantageous if a housing of the container and the fluid outlet means can be made in one integral piece, as this facilitates the manufacturing process and reduces manufacturing costs. In the case of the present invention, this is a practical possibility, as the present invention does not require the addition of a component. For example, starting from a situation of a known vent pipe, the present invention involves no more than having grooves in an inner surface of the vent pipe. In general, it is possible for the housing of the container and the fluid outlet means to be made as an injection moulded piece, wherein the shape of this piece can be without under cuts, such that release of the piece from the mould during the manufacturing process does not require an addition of sliders during the manufacturing process.

In addition to having at least one recessed portion of the surface defining the hole of the fluid outlet means, the present invention proposes another measure for preventing the hole of the fluid outlet means from being blocked. In the container according to the present invention, the container is furthermore equipped with at least one projection extending inwardly in the container from a position near the hole of the fluid outlet means. The projection helps in preventing relatively large particles from blocking the entire hole by keeping such particles at a distance from the hole.

Preferably, the projection is positioned near a recessed portion of the surface defining the hole of the fluid outlet means. In that way, it is ensured that the recessed portion remains open under all circumstances. Within the scope of the present invention, possible configurations in which the projection may be said to be positioned near a recessed portion of the surface defining the hole of the fluid outlet means involve a configuration in which the projection is positioned at a distance from a circumference of the recessed portion which is equal to or smaller than a smallest projected dimension of a cross-section of the recessed portion at an entrance side, i.e. a side associated with a liquid containing portion of the container, where particles might enter the hole.

An advantageous position of the projection is a position which is at least partly in an area which is present between a circumference of the hole and an imaginary convex polygon closely surrounding the circumference, in order to have optimal protection of the hole and the recessed portion of the surface defining the hole against blockage by a relatively large particle. In this respect, for sake of completeness, it is noted that a convex polygon is a polygon in which all interior angles are less than 180°, and in which all the line segments connecting any pair of its vertices (points which describe corners/intersections of the polygon) remain inside or on the boundary of the polygon. A convex polygon closely surrounding the circumference may be defined as a convex polygon which surrounds the hole in such a way that the largest length dimension of the polygon equals the largest length dimension of the hole, in a cross-section of the hole at the entrance side, and that all line segments of the polygon are tangents of the hole.

A position of the projection which may be even nearer to the recessed portion of the surface defining the hole of the fluid outlet means, and which may therefore be very effective in protecting the recessed portion from blockage, is a position which is at least partly in an area which is present between a circumference of the hole and an imaginary convexly curved, closed loop surrounding the circumference of the hole as close as possible, i.e. as if the loop were comparable to a tight rubber band arranged around the circumference of the hole.

Preferably, the number of projections is at least equal to the number of recessed portions of the surface defining the hole of the fluid outlet means, so that each of the recessed portions is associated with at least one projection. In that case, it is guaranteed that each recessed portion is properly protected against blockage by a relatively large particle. As explained in the foregoing, when the recessed portion is open, it is always possible to have pressure reduction in the container if necessary, even if a central portion of the hole is blocked.

In respect of the embodiment of the container according to the present invention having at least one projection as defined in the foregoing, it is noted that it is also possible for the housing of the container, the fluid outlet means and the projection to be made in one integral piece, for example, an injection moulded piece, wherein no additional measures are required for realizing release of the piece from a mould during the manufacturing process.

For sake of completeness, it is noted that in a practical embodiment of the container according to the present invention, the fluid outlet means are positioned at a side of the container which is a top side in a normal, operational orientation of the container. With that position of the fluid outlet means, the means are capable of optimally performing a function of letting out gas from the container, as gas normally leaves liquid at a top side.

All in all, the present invention provides an advantageous solution to the problem of guaranteeing a possibility to allow fluid to escape from a container which is equipped with fluid outlet means. In the first place, at least one recess is arranged in a surface defining a hole of the fluid outlet means, so that the function of letting out fluid is still maintained when the hole is clogged. Furthermore, it is proposed to have at least one projection in the vicinity of the hole, so that total blockage of the hole and the recess by a relatively large particle is prevented.

It is noted that the present invention basically resides in having at least one recessed portion of the surface defining the hole of the fluid outlet means, but that unexpected and most advantageous effects are obtained when the at least one projection is provided as well. The projection may be positioned such as to ensure that the recessed portion cannot be sealed by a particle. At the location where the projection is present, there cannot be an attachment of a particle to a surface area. Instead, it is most likely for a particle to rotate out of the way of the recessed portion as long as it is contacting the projection, under the influence of turbulent flows of fluid at the entrance side of the recessed portion. Not only is the projection a physical item for keeping particles at a distance from an entrance of the recessed portion, it is also capable of enhancing the turbulence when it is arranged at a suitable position, so that the effectiveness of its very presence is enhanced in combination with the recessed portion.

The above-described and other aspects of the present invention will be apparent from and elucidated with reference to the following detailed description of embodiments of a container according to the present invention.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
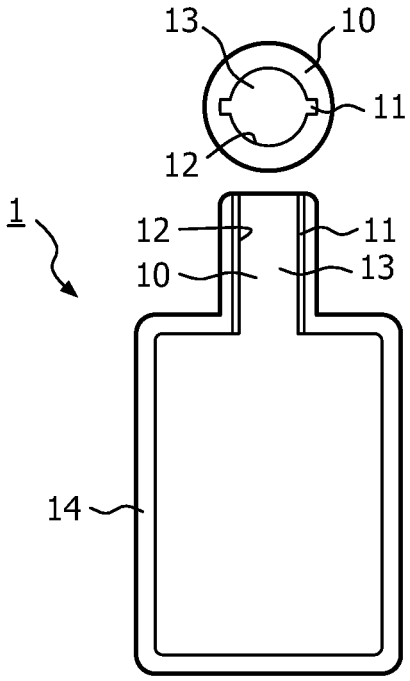
FIG. 1 diagrammatically shows a sectional view of a container according to a first embodiment of the present invention having a vent pipe, and a top view of the vent pipe.

FIG. 1 diagrammatically shows a sectional view of a container 1 according to a first embodiment of the present invention having a vent pipe 10, and furthermore shows a top view of the vent pipe 10.

The container 1 is suitable for containing a quantity of liquid, and is suitable to be applied in a device which is equipped for heating a liquid content of the container 1. The vent pipe 10 has a function in preventing a situation in which a pressure prevailing inside the container 1 reaches a dangerously high level, i.e. a level at which the pressure may cause the container 1 to get damaged. Without the presence of a vent pipe 10 or the like for allowing gases and possibly also excess liquid to exit the container 1, the pressure would rise and rise during a heating process of liquid under the influence of a growing quantity of gases escaping from the liquid, and of the expansion of the liquid.

Advantageously, the vent pipe 10 is located at a top side of the container 1, as the top side is the side where gases accumulate. In order to assure proper functioning of the vent pipe 10, it is important that measures are taken for avoiding elimination of the venting function of the vent pipe 10. According to the present invention, such measures involve an arrangement of a recess 11 in an inner pipe surface 12 delimiting the hollow space 13 of the vent pipe 10. FIG. 1 clearly illustrates the fact that the recessed portion 11 of the inner pipe surface 12 may be a groove 11 extending along the length of the vent pipe 10. In particular, in the shown example, two of such grooves 11 are present in the vent pipe 10. Within the scope of the present invention, the number of recessed portions 11 can be chosen freely, wherein the minimum number is one.

With the presence of the grooves 11, when the vent pipe 10 is blocked by a particle, it is still possible to have fluid transported from inside the container 1 to outside the container 1, wherein a pressure prevailing inside the container 1 can be kept at an acceptable level. In particular, when a particle is stuck inside the vent pipe 10, or when contaminations are clogging the vent pipe 10, the grooves 11 still have a function in allowing for fluid communication between the inside of the container 1 and the outside of the container 1, wherein the grooves 11 provide a by-pass of the blockage, as it were.

With respect to the grooves 11, it is noted that they may have any suitable shape, size, and mutual positioning, as long as they are capable of providing a passage between the inside of the container 1 and the outside of the container 1, so that fluid can escape from the container 1 as soon as pressure builds up.

The container 1 may be made of any suitable material. It is possible that the vent pipe 10 is an integral part of the container 1, wherein a housing 14 of the container 1 and the vent pipe 10 are made in one integral piece. For example, the container 1 may be made by applying injection moulding techniques. In this respect, it is noted that there is no need for under cuts, so that the piece can be released from a mould without adding sliders.

Figure 2:
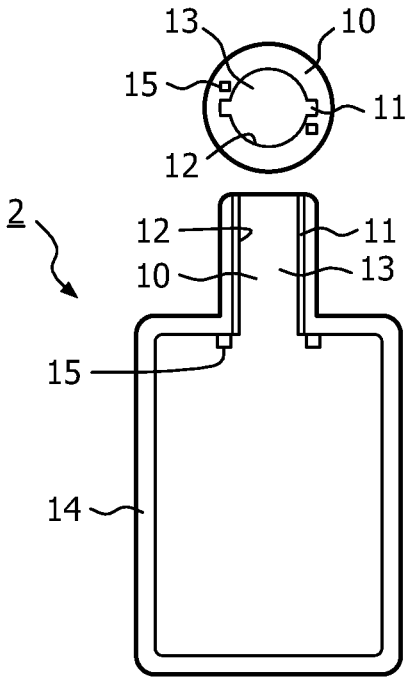
FIG. 2 diagrammatically shows a sectional view of a container according to a second embodiment of the present invention having a vent pipe, and a top view of the vent pipe.

FIG. 2 diagrammatically shows a sectional view of a container 2 according to a second embodiment of the present invention having a vent pipe 10, and furthermore shows a top view of the vent pipe 10.

The container 2 according to the second preferred embodiment of the present invention resembles the container 1 according to the first preferred embodiment of the present invention to a large extent. However, the container 2 according to the second preferred embodiment of the present invention has an additional feature, namely two projections 15 extending inwardly in the container 2 from a position near a base of the vent pipe 10, wherein each of the projections 15 is positioned near another one of the grooves 11.

On the basis of the presence of the projections 15, a situation in which a relatively large particle would be capable of blocking an entrance of the vent pipe 10 including the grooves 11 is prevented. The projections 15 serve for keeping such particle at some distance from the entrance of the vent pipe, so that there is always some room for fluid to escape. The positioning of the projections 15 near the grooves 11 is advantageous in view of the fact that at least the by-passing function of the grooves 11 is safe-guarded in that way, as there will surely be some room at the entrance of the grooves 11. It is therefore preferred to have at least as many projections 15 as there are grooves 11.

The addition of projections 15 can easily be realized, taking into account the fact that it is possible for the projections 15 to be an integral part of the container 2, besides the vent pipe 10.

With respect to the projections 15, it is noted that they may have any suitable shape, size, and mutual positioning, as long as they are capable of preventing particles from blocking the entrance of the vent pipe 10, particularly the entrance of the grooves 11.

Figure 3:
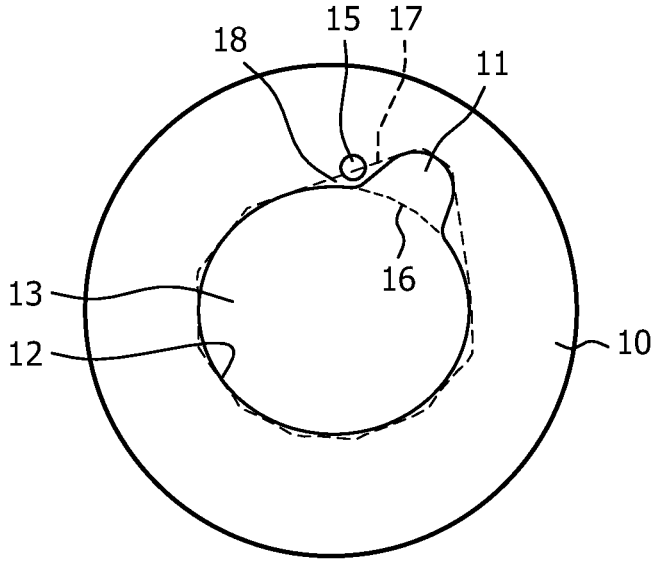
FIGS. 3 and 4 diagrammatically show an alternative top view of a vent pipe which is shaped according to the present invention.
Figure 4:
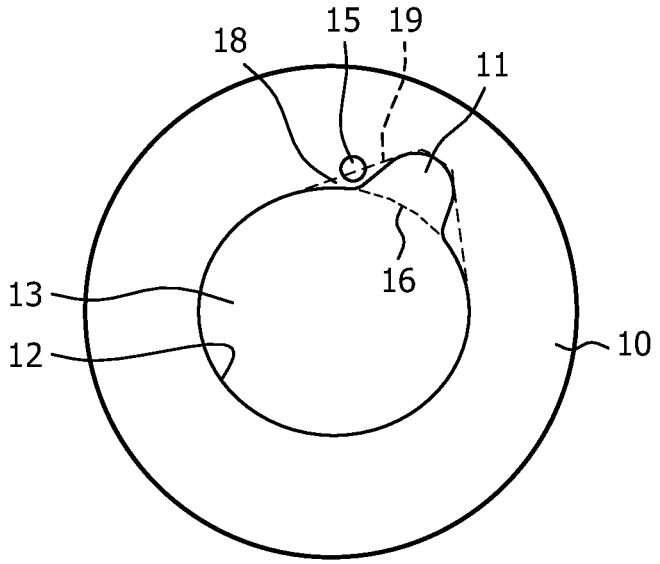

FIGS. 3 and 4 illustrate an alternative of the shape of the cross-section of the vent pipe. In this alternative, there is only one recessed portion 11 in the inner pipe surface 12 delimiting the hole 13. In FIGS. 3 and 4, a delimitation between the recessed portion 11 and the rest of the hole 13 is indicated by means of a dotted line 16. Furthermore, in the shown alternative, there is one projection 15, which is positioned close to the recessed portion 11. In fact, in the shape as shown, it is possible to indicate an imaginary convex polygon 17 closely surrounding a circumference of the hole 13, i.e. a cross-section of the inner pipe surface 12, as illustrated in FIG. 3. In order to have proper protection of the recessed portion 11 against closure by a particle, at least a part of the projection 15 is located in an area 18 which is present between the circumference and the convex polygon 17 as mentioned, wherein the projection 15 is really close to the recessed portion 11. Another option is to have the projection 15 located in an area 18 which is present between the circumference and an imaginary convexly curved, closed loop 19 surrounding the hole 13 as close as possible, as illustrated in FIG. 4.

In general, the present invention is suitable to be applied in situations in which fluid should be allowed to escape from an otherwise closed container 1, 2 for containing a liquid, and in which it is important to prevent blockage of means for facilitating such escape of fluid. The container 1, 2 according to the present invention can be applied in various types of devices, including devices comprising heating means for heating a liquid content of the container 1, 2. An example of such devices is a device for making a hot beverage.

In many feasible applications, the container 1, 2 is filled with water, but that does not alter the fact that the container 1, 2 may also be used for containing other types of liquid.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

For sake of completeness, it is noted that in the present description of the claimed invention, the term "fluid" is used for covering both gases and liquids.

The present invention can be summarized as follows. A container 1, 2 for containing a liquid such as water comprises fluid outlet means 10 having a hole 13 for allowing fluid to escape. A surface 12 defining the hole 13 is provided with at least one recessed portion 11. On the basis of the presence of the recessed portion 11 as mentioned, it is achieved that when the hole 13 of the fluid outlet means 10 is plugged with one or more particles, fluid can still escape through a passage formed by the recessed portion 11. Hence, on the basis of the presence of the recessed portion 11 as mentioned, safety is enhanced, as the risk of pressure inside the container 1, 2 getting too high is minimized.

In a preferred embodiment, the container 2 is further equipped with at least one projection 15 extending inwardly in the container 2 from a position near the hole 13 of the fluid outlet means 10. The projection 15 has a function in avoiding blockage of the entire hole 13, including the recessed portion 11, by a relatively large particle, as the projection 15 is suitable to be used for keeping such particle at a distance from an entrance of the hole 13.

The invention claimed is:

1. A container for a liquid, said container comprising:

a tubular fluid-outlet part having a longitudinally-extending inner surface defining a hole for allowing fluid to escape from the container, said inner surface including at least one longitudinally-extending groove formed therein and having an open end disposed for receiving and enabling the fluid in the container to escape via the at least one longitudinally-extending groove in the event that the hole becomes blocked by particulate matter in the liquid; and at least one projection positioned near the open end of the at least one groove to prevent blocking of said open end by said particulate matter.

2. A container according to claim 1 where the tubular fluid-outlet part is formed as an integral portion of the container.

3. A container according to claim 2 where the container and the fluid outlet part are formed as an integral injection molded piece.

4. A container according to claim 1 where the at least one projection extends away from said tubular fluid-outlet part and toward a bottom of said container.

5. A container according to claim 4 where a maximum distance of the at least one projection to a circumference of the at least one longitudinally extending groove is a smallest projected dimension of a cross-section of the at least one longitudinally extending groove at a side associated with a liquid containing portion of the container.

6. A container according to claim 4 where the at least one projection is positioned at least partly in an area located between a circumference of the hole and an imaginary convex polygon loosely surrounding the circumference.

7. A container according to claim 4 where the at least one projection is positioned at least partly in an area that is located between a circumference of the hole and an imaginary, convexly-curved, closed loop surrounding the circumference as closely as possible.

8. A container according to claim 4 where the number of projections is at least equal to the number of longitudinally extending grooves.

9. A container according to claim 1 where the tubular fluid-outlet part and the at least one projection are formed as an integral part of the container.

10. A container according to claim 9 including a housing for containing the fluid, the housing, the tubular fluid-outlet part and the at least one projection all being formed as an integral injection-molded piece.

11. A container according to claim 1 where the tubular fluid-outlet part is positioned at a side of the container that is a top side in a normal, standing orientation of the container.

12. An apparatus for heating a liquid, said apparatus comprising:

a container for the liquid including a tubular fluid-outlet part having a longitudinally-extending inner surface defining a hole for allowing fluid to escape from the container to relieve internal pressure, said inner surface including at least one longitudinally-extending groove formed therein and having an open end disposed for receiving and enabling the fluid in the container to escape via the at least one longitudinally-extending groove in the event that the hole becomes blocked by particulate matter in the liquid, said container including at least one projection positioned near the open end of the at least one groove to prevent blocking of said open end by said particulate matter; and a heater for heating liquid in the container.

13. An apparatus as in claim 12 where the at least one projection extends away from said tubular fluid-outlet part and toward a bottom of said container.

* * * * *